United States Patent [19]

Resch

[11] Patent Number: 4,479,301

[45] Date of Patent: Oct. 30, 1984

[54] CABLE TERMINATING TOOL

[75] Inventor: Alois R. Resch, Heilbronn-Kirchhausen, Fed. Rep. of Germany

[73] Assignee: Allied Corporation, Morris Township, Morris County, N.J.

[21] Appl. No.: 371,568

[22] Filed: Apr. 26, 1982

[30] Foreign Application Priority Data

May 25, 1981 [DE] Fed. Rep. of Germany ..... 3120751

[51] Int. Cl.[3] ..... H01R 43/04

[52] U.S. Cl. ..... 29/721; 29/749; 29/751; 29/753; 29/760

[58] Field of Search ..... 29/749, 751, 753, 759, 29/760, 721, 720

[56] References Cited

U.S. PATENT DOCUMENTS

| | | | |
|---|---|---|---|
| 4,020,540 | 5/1977 | Casciotti et al. | 29/749 |
| 4,034,472 | 7/1977 | Cover et al. | 29/749 |
| 4,035,897 | 7/1977 | Over et al. | 29/749 X |
| 4,047,294 | 9/1977 | Quigley | 29/749 |
| 4,110,896 | 9/1978 | Roiko | 29/749 X |
| 4,245,387 | 1/1981 | Reidt | 29/749 |
| 4,393,580 | 7/1983 | Hall, Jr. | 29/749 |

*Primary Examiner*—Carl E. Hall

*Attorney, Agent, or Firm*—Roger H. Criss

[57] ABSTRACT

A tool for connecting a cable, particularly a flat cable, to a cable connector, particularly to a flat cable connector or the like. The known termination tools often have relatively complicated adjusting mechanisms for centering the cable connector in relation to the center of the press and for adjusting the working height for the various types of connectors. Finally, with the known tools, there is no possibility of visually monitoring the alignment of the cable conductors with the terminals during the mounting process. The present tool permits a cable connector, regardless of its total length or the number of contacts, to be automatically positioned precisely under the center of the press die by the action of pairs of symmetrically positioned ribs having sloping engagement surfaces. The tool also permits the vertical positioning of cable connectors of different total structural heights by simply reversing the orientation of the connector support. Finally, the tool offers the possibility of visually monitoring the positioning of the conductors during the mounting process through an optical prism.

18 Claims, 18 Drawing Figures

FIG. 3
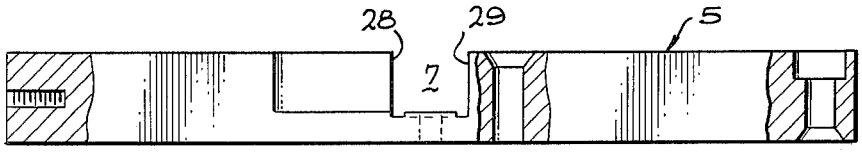
FIG. 4
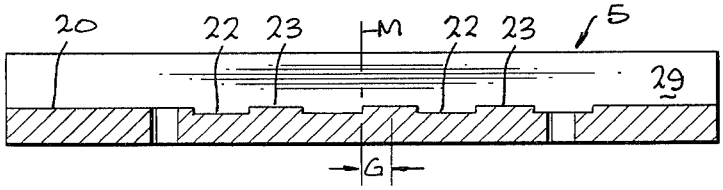
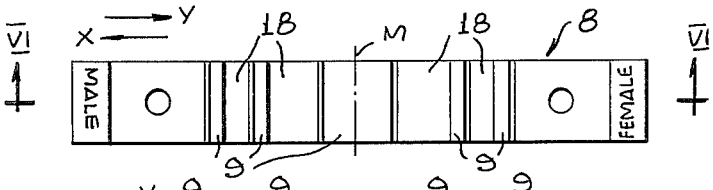
FIG. 5
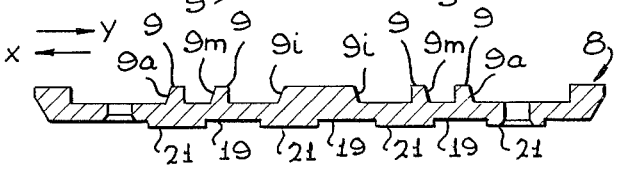
FIG. 6
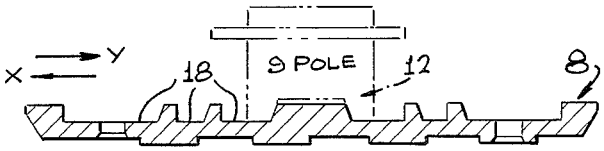
FIG. 6a
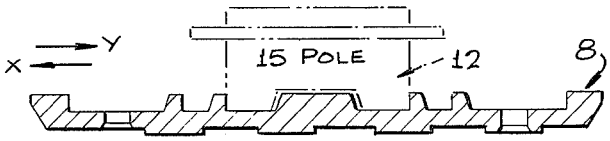
FIG. 6b
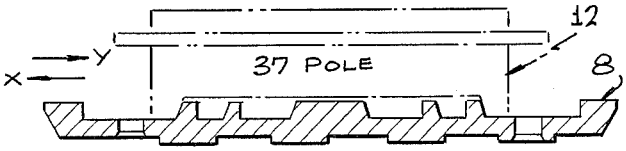
FIG. 6c
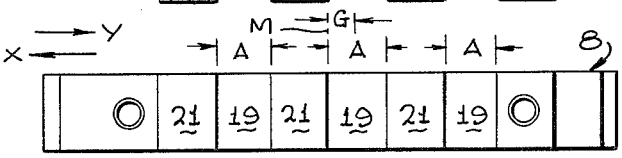
FIG. 7

FIG. 8
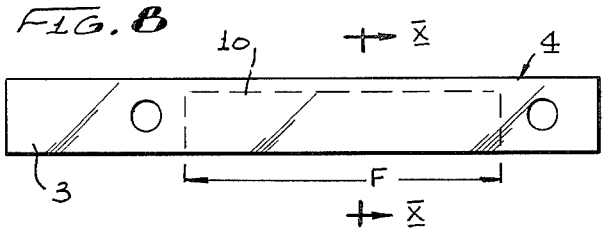
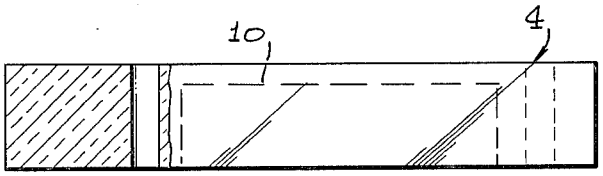
FIG. 9
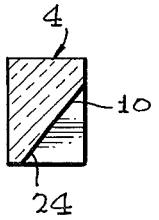
FIG. 10
FIG. 11
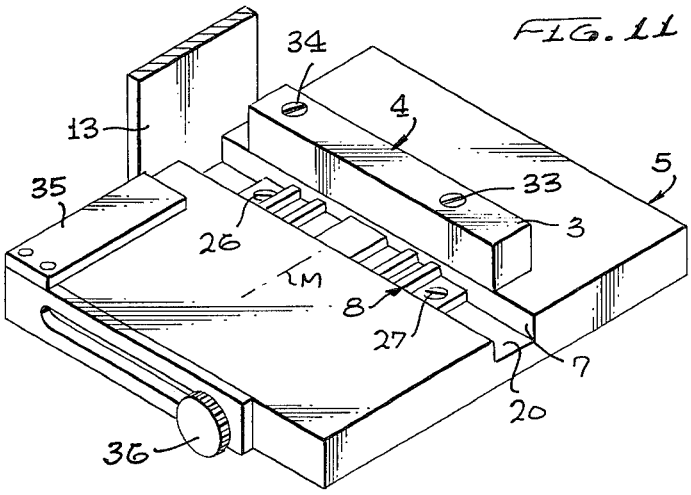
FIG. 13a
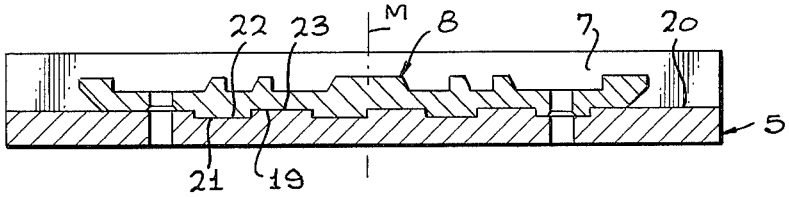
FIG. 13b
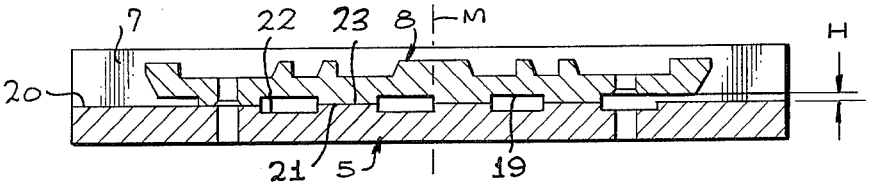

CABLE TERMINATING TOOL

TECHNICAL FIELD

This invention concerns a tool for connecting a cable, particularly a flat cable, to a connector, particularly to a flat cable connector or the like. More particularly, this invention relates to pressing devices for forcing the conductors of a cable into the terminals of a connector and to the mechanisms for holding the connector and for positioning the cable.

BACKGROUND OF THE PRIOR ART

The known tools of the aforementioned type often have relatively complicated adjusting mechanisms for centering the cable connector in relation to the center of the press. Furthermore, with the known tools, the actual working height of the press die must be reset each time for the various types of flat cable connectors because of their varying total structural height. This is relatively time consuming and, besides that, inexact. Finally, with the known tools, there is no possibility of visually monitoring the alignment of the cable conductors with the terminals during the mounting process. This means that misalignment of the conductors is usually not discovered until it is too late.

BRIEF SUMMARY OF THE INVENTION

Therefore, it is the goal and purpose of this invention to devise a cable terminating tool of the type mentioned that permits a cable connector, regardless of its total length of the number of contacts, to be automatically positioned precisely under the center of the press die, that permits the proper vertical positioning of cable connectors of vaious total structural heights, and that offers the possibility of visually monitoring the positioning of the conductors during the mounting process.

This adjustment problem of the prior art devices is solved by the invention in that cable connectors of various sizes can, before the cable is mounted, be placed on a centering device which automatically aligns the center of the cable connector with the center of the press die.

Additionally, in a preferred embodiment of the invention, an optical prism is intentionally provided on a bar which forms a stop surface against which an end of the cable is abutted. The width of the prism preferably corresponds to the width of a flat cable with the largest conventional number of single conductors. According to the invention, the prism has a reflecting surface which is tilted toward the direction of insertion of the flat cable by an angle of inclination that should lie in the range of about 30° to 60° and preferably should be 40°. In this way the ends of the individual conductors of the flat cable placed against the stop surface, but not directly visible to the person using the tool, are reflected approximately perpendicularly upwards, and thus are made visible to the person using the tool and can be monitored by him. Of course, it is particularly advantageous to make the entire bar out of transparent material and construct it as one piece with the prism. If ever the bar is not needed because the flat cable is to be looped through the cable connector, the bar can be easily removed because it is mounted on the mounting plate so it can be loosened or removed.

An additional inventive feature provides for the cable stop bar to have devices that make sure that it can only be mounted on the mounting plate in the correct one of several possible positions. These devices are made up of two fastening pins unsymmetrically mounted on the bar. These pins can only be inserted into the mounting plate in one orientation of the bar since the extending end portion of the bar engages the frame of the tool and prevents insertion of the pins if the bar is improperly oriented.

According to the invention, the centering device has sets of shoulder-like camming protrusions against which oppositely facing surfaces provided on the cable connector slide as the connector is inserted in the tool. These protrusions provide lateral biasing of the connector to exactly center the connector with respect to the pressing die. The individual protrusions of each different set of protrusions are spaced to engage the surface of a different size of connector.

Moreover, the centering device is intentionally provided on its underside with several protruding flanges that are, in a first orientation of the centering device, aligned with and received in depressions provided in the mounting plate, and, when the centering device is rotated 180° with respect to the mounting plate, the protruding flanges are between the depressions. Accordingly, in this second orientation, the centering device, as well as the cable connector resting on it, are raised a distance equal to the height of the extending flanges.

BRIEF DESCRIPTION OF THE DRAWINGS

Additional features, details and advantages can be found in the following description of a preferred embodiment of the invention as well as in the drawings, wherein:

FIG. 3 is a partial cut away side view of the mounting plate as per FIG. 2;

FIG. 4 is a longitudinal section through the mounting plate along the cut line IV—IV in FIG. 2;

FIG. 5 is a top view of a centering bar of the invention as per FIG. 1 that can be mounted on the mounting plate as per FIGS. 2 to 4;

FIG. 6 is a longitudinal section through the centering bar along the cut line VI—VI in FIG. 5;

FIGS. 6*a* to 6*b* are views of the centering bar as per FIGS. 5 and 6, on which flat cable connectors of various lengths and having various numbers of contacts are placed;

FIG. 7 is a bottom view of the centering bar as per FIG. 5;

FIG. 8 is a top view of a cable stop bar of the tool as per FIG. 1 that can be mounted on the mounting plate of FIGS. 2 to 4;

FIG. 9 is a side view of the cable stop bar as per FIG. 8;

FIG. 10 is a cross-section through the cable stop bar along the cut line X—X in FIG. 8;

FIG. 11 is a perspective composite view of the mounting plate, centering bar and cable stop bar as per FIGS. 2, 5 and 8;

FIG. 13*a* is a longitudinal section through the tool in a first operating position, that is through a groove of its mounting plate and through the centering bar placed in it along the cut line XIII—XIII in FIG. 12;

FIG. 13*b* is a longitudinal section through the tool in a second operating position, corresponding to FIG. 13*a*, with the centering bar presented now in a position rotated 180°.

DETAILED DESCRIPTION OF THE INVENTION

Figure 1:
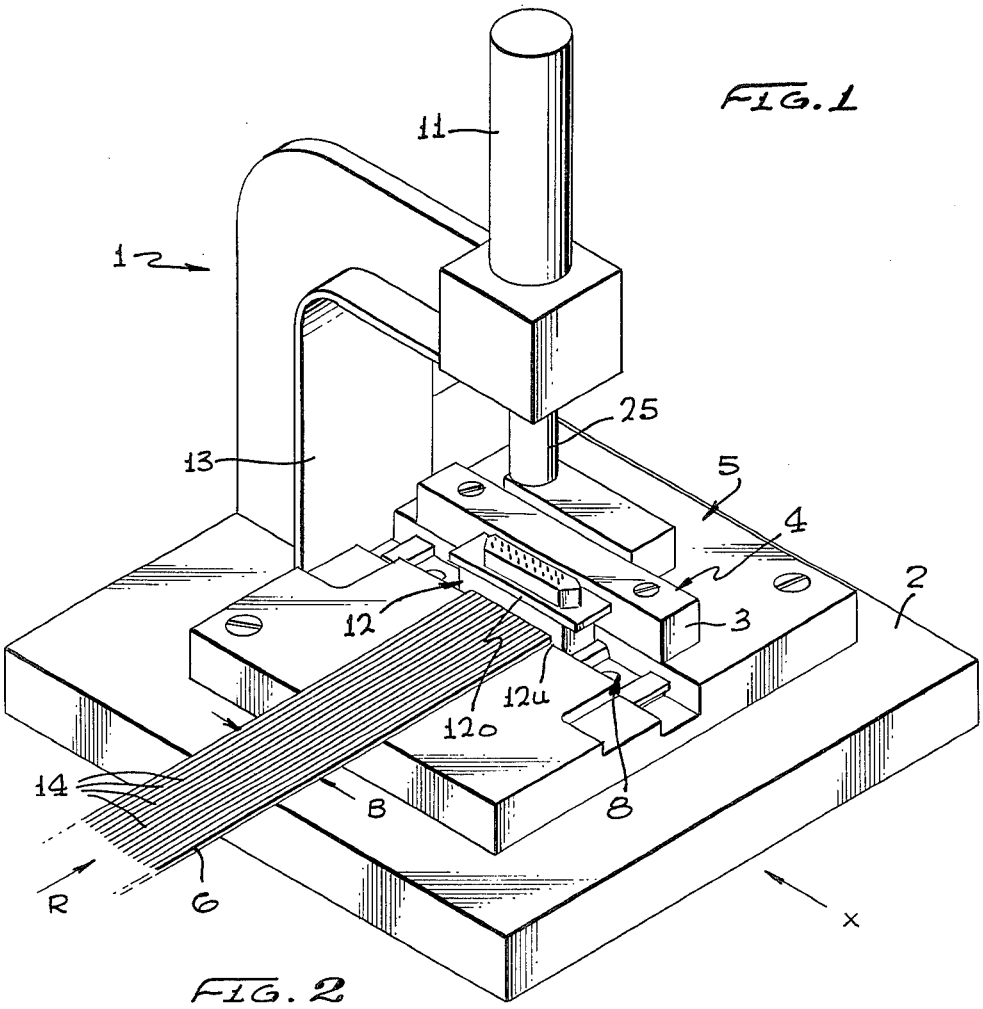
FIG. 1 is a perspective overall representation of the tool as per the invention.
Figure 2:
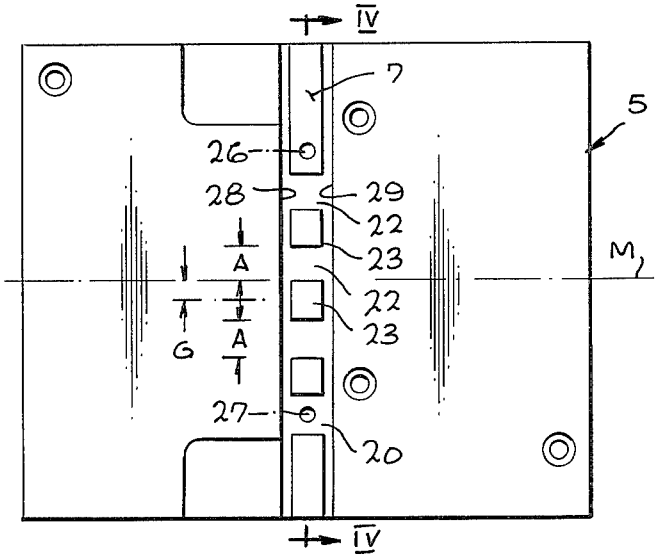
FIG. 2 is a top view of a mounting plate of the tool as per FIG. 1.

FIG. 1 shows a tool 1 as per the invention with a mounting plate 5 provided over a base plate 2, a centering bar 8 mounted on the mounting plate, cable stop bar 4 mounted on the mounting plate 5, and a press device 11 positioned over the centering bar in the operating position for connecting a flat cable 6 to a cable connector 12.

A preferred embodiment of the tool of the present invention is shown in FIG. 1. Preferably, a person will operate the tool from a direction X, from which he inserts the flat cable 6 with his left hand pushing the cable in the direction of insertion R into the tool 1. The end of the cable is laid across the bottom section 12*u* of the flat cable connector 12 far enough so that the ends of its single conductors 14 make contact with the cable stop bar 4. The operator then places the top section 12*o* of the flat cable connector 12 in position above the bottom section 12*u* and the flat cable 6. Finally, the press device 11 is operated to press the top section 12*o* onto the bottom section 12*u* of the flat cable connector 12. By doing so, each conductor 14 of the flat cable 6 is connected, according to known splicing techniques, to a respective connecting terminal (not shown in this drawing) of the individual contacts of the flat cable connector 12. In this process, the press device 11 can be operated manually or by machine, which does not need to be explained in greater detail here, since this is of secondary importance for the description of the object of the invention and is readily known in the art.

The mounting of a flat cable 6 on a cable connector 12 using the known splicing techniques, as described briefly above, makes it necessary to position the press die 25 of the press 11 exactly over the center of the top section 12*o* of the cable connector 12. The press must apply the connecting force to the exact center of the connector. If there is an eccentric application of pressure, the top section 12*o* could tip or tilt in relation to the bottom section 12*u*. This will bend the terminal portions of the connector contacts and result in poor connections with the conductors of the cable or result in shorting between the terminals.

In the interests of a problem-free mounting, it is therefore important to accurately align the center of the bottom section 12*u* of the flat cable connector 12 in the directions R and X with the press die of the press 11. The centering bar 8 is provided essentially for this purpose. As shown in FIG. 11, the bar 8 is preferably mounted to the mounting plate 5 by means of fasteners 26 and 27 that can be loosened to allow positioning of the centering bar in a groove 7 of the mounting plate 5. The center line M of the centering bar 8 is adjusted to lie directly below the center of the press.

As can be seen especially in FIGS. 5, 6, 6*a*–6*c* and 7, the centering bar 8 has on each side of its center line M symmetrically arranged ribs 9. The ribs preferably have a trapezoidal cross-section defining sloping cam surfaces 9*a*, 9*m*, 9*i*. The cam surfaces 9*a* of the outermost placed pair of ribs are used in centering extended cable connectors 12 having a large number of poles (e.g. 37). The cam surfaces 9*i* of the innermost pair of ribs are used in centering short cable connectors 12 having a small number of poles (e.g. 9). The sloping surfaces 9*m* of a pair of intermediate ribs are used in centering medium length cable connectors 12 having a medium number of poles (e.g. 15). In use, the pair of opposing surfaces 9*a*, 9*i* or 9*m* engage the counter surfaces provided on the bottom section 12*u* of the cable connector 12 in such a way that the flat cable connector 12 is aligned and then prevented from moving both in the X and the Y direction in relation to the press device 11. In FIGS. 6*a*–6*c* the placement of a 9, 15 or 37 pole connector 12 on the centering bar 8 is shown.

The positioning of the bottom section 12*u* of the cable connector 12 in the direction R and in the direction opposite to it is accomplished by the side surfaces 28, 29 (see FIG. 3) of the groove 7 against which the sides of the connector rest as it is mounted.

Besides the fundamental advantage of this invention in aligning and holding the bottom section 12*u* of a flat cable connector 12 exactly at the center on the mounting plate 5 of a mounting tool, a further embodiment of the invention allows the height of the bottom section 12*u* to be easily adjusted with relation to the mounting plate 5. In this way, the various heights of the bottom sections 12*u* of the various types of cable connectors 12 (for example ones with female plugs or others with male plugs) can be compensated for in such a way that the separation plane between the bottom section 12*u* and the top section 12*o* of different flat cable connectors is constantly at the same height. Thus, the press device 11 does not need to be altered by time consuming conversion measures even when there is a shift in production, as is the case for many known cable terminating tools.

This advantage is realized according to the invention in the following amazingly simple manner. As shown in FIG. 7, the centering bar 8 is provided on its bottom surface with several extending flanges 21 at a distance A from each other and displaced assymetrically by the amount G to the center line M with alternating depressions 19 placed in between. As shown in FIG. 4, the surface 20 of the groove 7 of the mounting plate 5 includes a number of depressions 22 corresponding in number to the flanges 21. The depressions 22 are provided at a distance A from each other and are also displaced by the amount G to the center of the press 11. Flanges 23 are positioned between each of the depressions 22.

As shown in FIG. 13*a*, the centering bar 8 can be installed in the groove 7 in a first orientation in such a way that the flanges 21 of the centering bar 8 each come to lie in a cam depression 22 of the groove 7. In a second orientation shown in FIG. 13*b*, the centering bar has been rotated 180° from the first orientation. In the second orientation, the flanges 21 are each placed on flanges 23 provided alternatingly between the depressions 22 on the surface of the groove. In the second orientation, the centering bar 8 is raised by an amount corresponding to the height H of the flanges 21.

Figure 12:
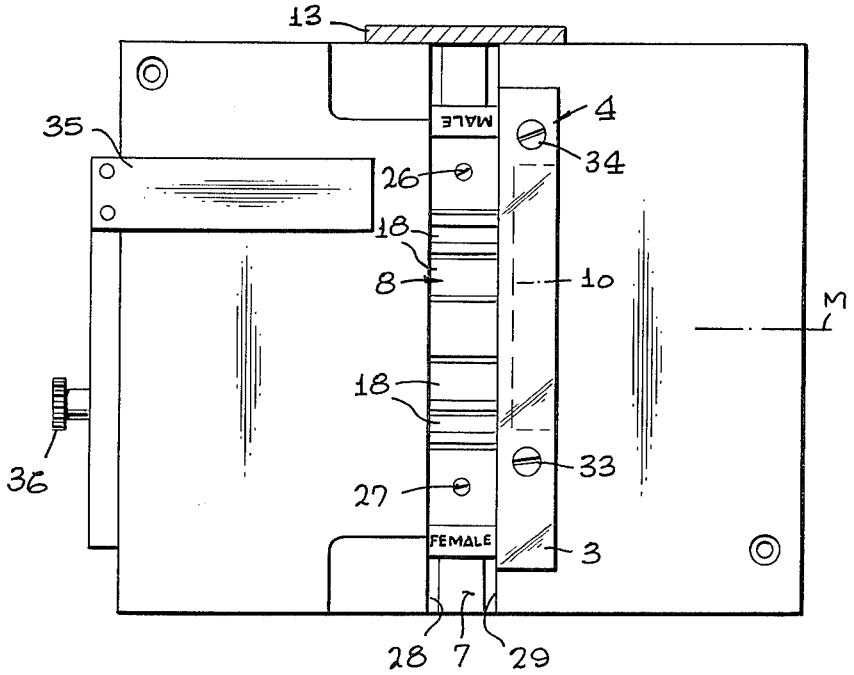
FIG. 12 is a top view of the composite view as per FIG. 11.

As can be seen in FIGS. 5 and 12, in the embodiment of the invention described here, an end of the centering bar 8 is provided with the English label "female" while its other end bears the English label "male".

The above description implies that of the cable connectors 12 referred to herein and intended to be connected to a flat cable 6, those provided with female contacts have a greater total structural height than the cable connectors 12 provided with male contacts. Now, regardless of whether cable connectors 12 with female contacts or ones with male contacts are to be connected to a flat cable, there is no need to adjust the press stroke from one use to the other since the differences in height of the different connectors are compensated for by movement of the centering device 8.

For example, in the embodiment of the invention described here, the centering bar 8 is mounted in the orientation shown in FIG. 12 for mounting cable connectors with female contacts. With the operator sitting or standing at the side of the tool coreesponding to the bottom edge of FIG. 12, as suggested above, and with the centering bar as shown in FIG. 12, the label "female" is placed so it can be read. This indicates that the centering bar 8 is in the deeper position required for mounting cable connectors provided with female contacts.

On the other hand, if the centering bar 8 is, after the fastening screws 26 and 27 have been loosened or removed, rotated 180° in the groove 7 of the mounting plate 5 and is fastened again on the mounting plate by means of the screws 26 and 27, the operator will see the label "male". This means that the centering bar 8 has been appropriately raised for mounting cable connectors provided with male contact elements. In this orientation, the flanges 21 no longer sit in the depressions 22 provided in the groove 7 but rather on the flanges 23 provided between them, as can be seen by observing the drawing, particularly in FIG. 13*b*.

General experience in life teaches that trusting is good but seeing is better. According to the invention, besides the mechanical measures described above to achieve a dimensionally exact arrangement of the cable connector 12 and of a flat cable 6, the opportunity for an optical monitoring of the alignment is also provided.

Figure 14:
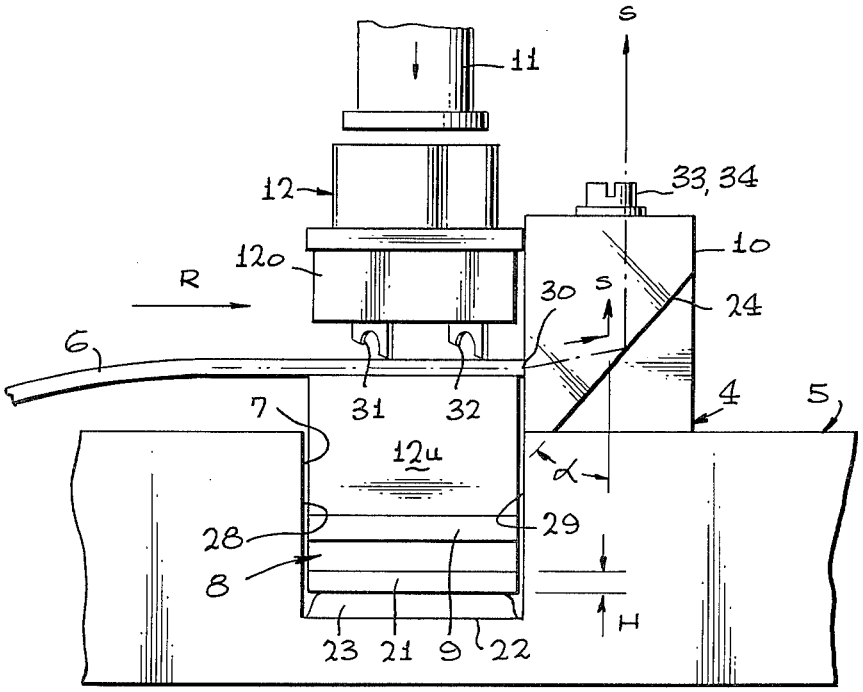
FIG. 14 is a schematic representation of the parts required for the functioning of the tool as per FIG. 1, namely the mounting plate, the centering bar, the holding bar as well as a press device placed over it in the operating position with a flat cable connector that is inserted into the tool and connected to a flat cable.

According to FIGS. 8 to 10, the cable stop bar 4 for the flat cable 6 has, according to an embodiment of the invention, an optical prism 10 with a length F corresponding to about the width B of the flat cable 6 (as shown in FIG. 1). Although the prism 10 could be a separate part mounted on the cable stop bar 4, according to a preferred embodiment of the invention, the cable stop bar 4 is made completely out of a transparent material, preferably Plexiglas$^R$, and the prism 10 is formed integrally with it. A reflecting surface 24 of the prism 10 is provided on the cable stop bar 4 and tilted toward the direction of insertion R of the flat cable 6 (as shown in FIG. 14) at an angle $\alpha$ to the vertical which is about 30° to 60° and preferably is 40°. When the end 30 of the flat cable 6 is positioned over the bottom connector section 12*u*, and is moved into contact with the cable stop bar 4 in the direction of insertion R, its image follows the path of ray S shown in FIG. 14. The image is reflected somewhat perpendicularly upwards and thus is made visible to the operator. The view afforded through the prism 10 reveals any errors in mounting that may occur. For example, insufficiently deep or oblique insertion of the flat cable 6 into the tool can immediately be recognizable by sight, which is not possible with the known mounting devices of the kind mentioned at the beginning. With the known devices in which optical or visual monitoring is not possible, misalignment of the connector or improper insertion of the cable could not be recognized until it was too late and the cable and connector had been removed from the tool, usually with damaged terminals or poor connections. Without a resource or helpful device of this kind, as represented by the prism 10 described above, it would generally not be possible to visually check for the correct placement of the flat cable 6 since the distance between the cable connector 12 and the cable stop bar 4 is necessarily much too small for this.

If the cable connector 12 is not to be installed at an end of the cable 6, but rather somewhere intermediate its ends, the removable fasteners 33 and 34 holding the cable stop bar 4 may be loosened or removed allowing the cable stop bar 4 to be removed. In this case a direct visual monitoring is indeed possible, but is really superfluous because the flat cable 6 is visable on both sides of the connector and can be easily aligned from above.

As shown in FIG. 1, in order to avoid the possibility of an erroneous, laterally inverted mounting of the cable stop bar 4 together with the prism 10 on the mounting plate 5, the cable stop bar 4 may be provided with an extension 3 at one end which would hit against a frame section 13 of the tool 1 if the mounting of the cable stop bar 4 were laterally inverted.

Finally, as shown in FIGS. 11 and 12, a guide stop 35 that is adjustable by means of an adjusting device 36 may be placed on the mounting plate 5. When this stop is positioned, aligning one side of the flat cable with the edge of the stop makes it possible to insert the cable into the tool 1 at the proper angle and in the proper lateral position.

From the foregoing, it can be readily realized that the invention can have many variations and modifications which will be evident to an expert in the field of art involved. Accordingly, it is to be understood that the invention is not to be limited to the specific embodiments and examples described herein, but is to be limited only by the appended claims.

I claim:

1. A cable terminating tool for connecting the conductors of a multiconductor flat cable to respective terminals of a connector comprising:

a mounting plate;

a centering means coupled to said mounting plate for receiving the connector and locating the connector in a predetermined position relative to said mounting plate, said centering means comprising a plurality of pairs of ribs provided on a surface of said centering means, said ribs running parallel to the direction of insertion of said flat cable, each of said ribs comprising a member having a somewhat trapeziodal cross section shaped to cooperate with counter surfaces provided on said connector to hold the connector stationary after it is placed in the centering means, each corresponding counter surface to the members of each pair of ribs provided on said connector is adapted to engage a surface of a respective member of each of said pairs of ribs;

stop means coupled to said mounting plate and having a cable abutting face for positioning an end of the cable at a point adjacent to said predetermined position; and press means mounted on said mounting plate and operable to press the conductors of a cable into the conductor receiving terminals of a connector received by said centering means.

2. A cable terminating tool as claimed in claim 1, wherein said stop means includes an optical prism.

3. A cable terminating tool as claimed in claim 2, wherein the width of said prism is at least equal to the width of the cable receiving portion of a connector receivable by said centering means.

4. A cable terminating tool as claimed in claim 2, wherein said optical prism includes a reflective surface oriented at an angle of inclination of between 30° and 60° to the vertical.

5. A cable terminating tool as claimed in claim 4, wherein said angle of inclination is approximately 40°.

6. A cable terminating tool as claimed in claim 2, wherein said optical prism is oriented such that an end of a cable abutting said stop means is visible through said prism to an operator above said pressing means.

7. A cable terminating tool as claimed in any one of claims 2–6, wherein said stop means is transparent.

8. A cable terminating tool as claimed in claim 7, wherein said stop means is integrally formed with said optical prism.

9. A cable terminating tool as claimed in claim 1, wherein said stop means is movable relative to said mounting plate to allow the installation of a connector at a point on a cable remote from the ends thereof.

10. A cable terminating tool as claimed in claim 1, wherein said stop means includes orienting means allowing said stop means to be mounted in only one orientation.

11. A cable terminating tool as claimed in claim 10, wherein said orienting means includes asymmetrically arranged alignment pins.

12. A cable terminating tool as claimed in claim 1, wherein said centering means can be adjusted for height.

13. A cable terminating tool for connecting the conductors of a multiconductor flat cable to respective terminals of a connector, said tool comprising;

a mounting plate;

means for locating and centering said connector and its terminals in a predetermined position relative to said mounting plate, said means comprising a plurality of pairs or ribs provided in a surface of said locating means, each of said ribs comprising a member having a somewhat trapezoidal cross section shaped to cooperate with counter surfaces provided on said cable connector to hold the connector stationary after it is placed in the locating means, the corresponding counter surfaces to each pair of ribs on said connector adapted to engage a surface of a respective member of a respective rib pair;

means for positioning each of the conductors of said cable beneath a respective terminal of said connector and parallel with the ribs of said locating means; and means for applying pressure between cable conductors in said positioning means and connector terminals located in said locating means to press the conductors of said cable into terminals of said connector.

14. A cable terminating tool as claimed in claim 13, wherein said locating and centering means includes a centering bar having said ribs thereon, and wherein said mounting plate includes a groove running perpendicular to the direction of insertion of the cable, said centering bar being located in said groove.

15. A cable terminating tool as claimed in claim 14, wherein said centering bar is fastened on the mounting plate so it can be removed from or moved in the groove of the mounting plate.

16. A cable terminating tool as claimed in claim 14 or 15, wherein said plurality of ribs and the recesses formed between them are each symmetrically arranged in pairs with respect to the center line of the centering bar, and wherein the center line of the centering bar is itself placed in line with the center of said press means.

17. A cable terminating tool as claimed in claim 14, wherein said centering bar is mounted so that it can be removed or loosened on a plane parallel to the plane of the mounting plate so that it can be rotated at will 180° in the groove of the mounting plate.

18. The cable terminating tool as claimed in claim 17 wherein the centering bar includes:

a plurality of flanges on the side of the bar facing the groove in the mounting plate, said flanges spaced at a selected distance from each other and displaced relative to the center line of said bar by a selected amount, the base of said groove in said mounting plate including a corresponding plurality of depressions that mate with the flanges of the centering bar in a first position and, in a second position 180° to said first position, said flanges engage the surface of said mounting plate between the depressions, whereby said centering bar in its second position is raised a distance equal to the height of said flanges.

* * * * *